US010812910B2

(12) United States Patent
Lilienthal et al.

(10) Patent No.: US 10,812,910 B2
(45) Date of Patent: Oct. 20, 2020

(54) INVERTED MOTOR TRANSDUCER WITH FRONT SPIDER

(71) Applicant: Harman International Industries, Incorporated, Stamford, CT (US)

(72) Inventors: Toni Otto Lilienthal, Northridge, CA (US); Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/131,752

(22) Filed: Sep. 14, 2018

(65) Prior Publication Data

US 2020/0092654 A1 Mar. 19, 2020

(51) Int. Cl.

| | |
|---|---|
| ***H04R 25/00*** | (2006.01) |
| ***H04R 9/04*** | (2006.01) |
| ***H04R 9/06*** | (2006.01) |
| ***H04R 1/02*** | (2006.01) |
| ***H04R 7/26*** | (2006.01) |
| ***H04R 9/02*** | (2006.01) |

(52) U.S. Cl.

CPC ..... *H04R 9/043* (2013.01); *H04R 1/02* (2013.01); *H04R 7/26* (2013.01); *H04R 9/022* (2013.01); *H04R 9/025* (2013.01); *H04R 9/045* (2013.01); *H04R 9/06* (2013.01); *H04R 2209/041* (2013.01); *H04R 2307/201* (2013.01)

(58) Field of Classification Search

CPC . H04R 9/043; H04R 1/02; H04R 7/26; H04R 9/022; H04R 9/025; H04R 9/06; H04R 2209/041; H04R 2307/00; H04R 31/003; H04R 9/045

USPC ..... 381/404

See application file for complete search history.

(56) References Cited

U.S. PATENT DOCUMENTS

| | | | | | |
|---|---|---|---|---|---|
| 2,551,447 | A * | 5/1951 | Marquis | H04R 9/025 | 381/412 |
| 4,737,992 | A * | 4/1988 | Latham-Brown | H04R 9/06 | 381/404 |
| 5,040,221 | A * | 8/1991 | Edwards | H04R 9/045 | 381/409 |
| 5,475,765 | A * | 12/1995 | Lyth | H04R 9/02 | 381/397 |
| 5,802,191 | A * | 9/1998 | Guenther | H04R 1/025 | 181/147 |

(Continued)

*Primary Examiner* — Phylesha Dabney
(74) *Attorney, Agent, or Firm* — Brooks Kushman P.C.

(57) ABSTRACT

An electrodynamic transducer includes a rear frame defining an open frame interior, and a front frame enclosing the open frame interior and attached to the rear frame, the front frame including a center hub disposed about a central axis of the transducer. A movable diaphragm is positioned within the open frame interior and operably connected to the rear frame. A magnet assembly is disposed forward of the diaphragm and coupled to the center hub, the magnet assembly defining a magnetic air gap annularly disposed about the central axis. A voice coil is disposed in the magnetic air gap surrounding the magnet assembly and operably connected to the diaphragm. A first spider is coupled between the voice coil and the rear frame behind the diaphragm, and a second spider coupled between the diaphragm and the front frame and disposed forward of the diaphragm.

8 Claims, 4 Drawing Sheets

(56) References Cited

U.S. PATENT DOCUMENTS

| | | | | |
|---|---|---|---|---|
| 7,016,514 | B2 * | 3/2006 | White | H04R 9/022 381/397 |
| 9,445,201 | B2 * | 9/2016 | Hyde | H04R 9/00 |
| 2004/0052397 | A1 * | 3/2004 | Aronson | H04R 9/022 381/397 |
| 2015/0139478 | A1 * | 5/2015 | Hyde | H04R 9/00 381/401 |
| 2017/0055084 | A1 * | 2/2017 | Hyde | H04R 9/00 |

* cited by examiner

INVERTED MOTOR TRANSDUCER WITH FRONT SPIDER

TECHNICAL FIELD

Embodiments relate to an inverted motor transducer, such as a low-frequency woofer, with a second, front spider forward of the diaphragm.

BACKGROUND

An electrodynamic transducer may be utilized as a loudspeaker or as a component in a loudspeaker system to transform electrical signals into acoustical signals. In a typical loudspeaker system, the transducer includes a magnetic motor assembly including one or more permanent magnets mounted between a top plate and a back plate, and a voice coil attached to a coil former and axially movable with respect to the motor assembly. The coil former and attached voice coil are inserted into an air gap of the motor assembly such that the voice coil is exposed to the magnetic field established by the motor assembly. The coil former is attached to a diaphragm constructed from a flexible material that is responsive to a vibrational input, such that the diaphragm is mechanically referenced to the voice coil.

During operation of the loudspeaker, electrical energy is supplied to the voice coil, causing the voice coil and attached diaphragm to move axially within the air gap. Electrical signals are transmitted as an alternating current through the voice coil, and the alternating current interacts with the constant magnetic field in the air gap. The interaction results in a Laplace force which is expressed as a product of the magnetic flux density, overall length of the turns of the voice coil linked to the magnetic flux, and the value of the electrical current running through the voice coil. Due to the Laplace force acting on the voice coil positioned in the magnetic field, the alternating current actuates the voice coil to reciprocate back and forth in the air gap and, correspondingly, move the diaphragm to which the coil former is attached. Accordingly, the reciprocating voice coil actuates the diaphragm to likewise reciprocate and, consequently, produce acoustic signals that propagate as sound waves.

Since the material of the voice coil has an electrical resistance, some of the electrical energy flowing through the voice coil is converted to heat energy instead of sound energy. Heat produced by the voice coil can build up and be radiated to surrounding surfaces of the transducer. The generation of resistive heat is disadvantageous for several reasons. First, the conversion of electrical energy to heat energy constitutes a loss in the efficiency of the transducer in performing its intended purpose, that of converting the electrical energy to mechanical energy utilized to produce acoustic signals. Second, excessive heat may damage the components or electrical interconnects of the loudspeaker and/or degrade the adhesives often employed to attach various components together and may even cause the loudspeaker to cease functioning. Increase of the voice coil temperature is accompanied by the increase of the voice coil's direct current resistance (DCR). Since all modern amplifiers are sources of voltage, the increase of DCR causes the decrease of sound pressure level (SPL) output. A voice coil temperature of 250 C corresponds to approximately double the DCR and, correspondingly, −6 dB drop in SPL which is also accompanied by a change of frequency caused by undamping of the loudspeaker's motor.

As additional examples, the voice coil may become detached from the coil former and consequently fall out of proper position relative to other components of the transducer, which adversely affects the proper electromagnetic coupling between the voice coil and the motor assembly and the mechanical coupling between the voice coil and the diaphragm. Also, excessive heat will cause certain magnets to become demagnetized. Thus, the generation of heat limits the power handling capacity and distortion-free sound volume of loudspeakers as well as their efficiency. Such problems are exacerbated by the fact that electrical resistance through a voice coil increases with increasing temperature. That is, the hotter the wire of the voice coil becomes, the higher its electrical resistance becomes and the more heat it generates.

The most common form of loudspeaker uses a single voice coil winding in a single magnetic air gap. However, loudspeaker performance may be enhanced by using a multiple coil/multiple gap design. A multi-coil transducer may include two or more separate windings axially spaced apart from each other to form two or more coils which are usually electrically connected so that the coils work together to move the diaphragm. As both coils provide forces for driving the diaphragm, the power output of the loudspeaker may be increased without significantly increasing size and mass. Many multi-coil/multi-gap designs can produce more power output per transducer mass and dissipate more heat than conventional single-coil designs. For example, a dual-coil design provides more coil surface area compared with many single-coil configurations, and thus can dissipate a greater amount of heat at a greater rate of heat transfer.

While the multiple coil/multiple gap construction has several advantages over single coil/single gap designs including higher power handling, reduced distortion, reduced inductance, and extended frequency response, there are several disadvantages with dual coil/dual gap speakers. First, insofar as a desired advantage of the dual-coil transducer is its ability to operate at a greater power output, operating the dual-coil transducer at the higher power output concomitantly causes the dual-coil transducer to generate more heat. As such, the improved heat dissipation inherent in the dual-coil design may be offset by the greater generation of heat. There can also be problems with overheated magnets due to the compact magnet assembly and the proximity of the magnets to the heat-generating voice coils. For example, as compared to single-coil transducers, adequate heat dissipation in many dual-coil transducers is a problem due to the longer thermal paths that must be traversed between the voice coil and the ambient environment.

Inverted motor transducers, mainly low-frequency woofers, have the motor assembly and voice coil positioned in front of the diaphragm, and offer several advantages over transducers with motors positioned behind the diaphragm. The first advantage is a shallower profile that makes an inverted motor transducer particularly popular in automotive audio systems where space is limited. The second advantage is better voice coil cooling since the coil is positioned outside the enclosure of a loudspeaker where the ambient temperature is typically lower than inside the enclosure. The lower temperature of the voice coil decreases thermal compression. In addition, the lower motor temperature decreases the risk of the demagnetization of magnets in the motor assembly. The third advantage is a better dynamic stability of the moving assembly because its gravity center is located between two suspension points, instead of outside the suspension points as in regular transducers.

Due to the nature of its configuration, an inverted motor transducer has a voice coil air gap which is open and vulnerable to detrimental foreign particles and dust. In a transducer with the motor positioned behind the diaphragm, the dust dome protects the air gap. In practical applications, predominantly in automotive audio systems, the air gap of inverted motor transducers may remain open, and protection from dust and particles is provided by an external grille. In an alternative configuration, protection of the air gap is provided by mesh that covers the entire surface of the front frame.

For practical applications in professional audio systems, the methods described above are not optimal. From the standpoint of protection from dust and particles, the first method leaves the inverted motor transducer at the mercy of the loudspeaker grille, and the air gap remains open in an individual transducer. The second method is not practical for large woofers because it requires a massive grille covering the entire surface of the front frame.

SUMMARY

In one or more embodiments, an electrodynamic transducer includes a rear frame defining an open frame interior, and a front frame enclosing the open frame interior and attached to the rear frame, the front frame including a center hub disposed about a central axis of the transducer. A movable diaphragm is positioned within the open frame interior and operably connected to the rear frame. A magnet assembly is disposed forward of the diaphragm and coupled to the center hub, the magnet assembly defining a magnetic air gap annularly disposed about the central axis. A voice coil is disposed in the magnetic air gap surrounding the magnet assembly and operably connected to the diaphragm. A first spider is coupled between the voice coil and the rear frame behind the diaphragm, and a second spider coupled between the diaphragm and the front frame and disposed forward of the diaphragm.

In one or more embodiments, an electrodynamic transducer includes a rear frame defining an open frame interior, and a front frame enclosing the open frame interior and attached to the rear frame, the front frame including a center hub disposed about a central axis of the transducer. A movable diaphragm is positioned within the open frame interior and operably connected to the rear frame. A magnet assembly is disposed forward of the diaphragm and coupled to the center hub, the magnet assembly defining a magnetic air gap annularly disposed about the central axis. A voice coil is disposed in the magnetic air gap surrounding the magnet assembly and operably connected to the diaphragm, and a first spider is coupled between the voice coil and the rear frame behind the diaphragm. A second spider is disposed forward of the diaphragm, the second spider including an inner flange attached to the center hub and an outer attachment portion attached to the diaphragm on a front side thereof, wherein the second spider provides a barrier to protect the voice coil and the magnetic air gap from contact with foreign particles.

In one or more embodiments, an electrodynamic transducer includes a rear frame defining an open frame interior, the front frame enclosing the open frame interior and attached to the rear frame, the front frame including a center hub disposed about a central axis of the transducer. The center hub including an outer wall, an inner wall, and an annular interior formed between the inner and outer walls. The center hub further includes spaced apertures in a top portion thereof which allow the annular interior to communicate with the ambient environment. A movable diaphragm is positioned within the open frame interior and operably connected to the rear frame, and a magnet assembly is disposed forward of the diaphragm and coupled to the center hub, the magnet assembly defining a magnetic air gap annularly disposed about the central axis and in communication with the annular interior of the center hub. A voice coil is disposed in the magnetic air gap surrounding the magnet assembly and operably connected to the diaphragm, and a first spider coupled between the voice coil and the rear frame behind the diaphragm. A second spider is coupled between the diaphragm and the front frame and disposed forward of the diaphragm, wherein when an electrical signal is passed through the voice coil to cause the voice coil and diaphragm to oscillate, the second spider pumps air in and out of the transducer through the magnetic air gap and the annular interior of the center hub.

DETAILED DESCRIPTION

Figure 1:
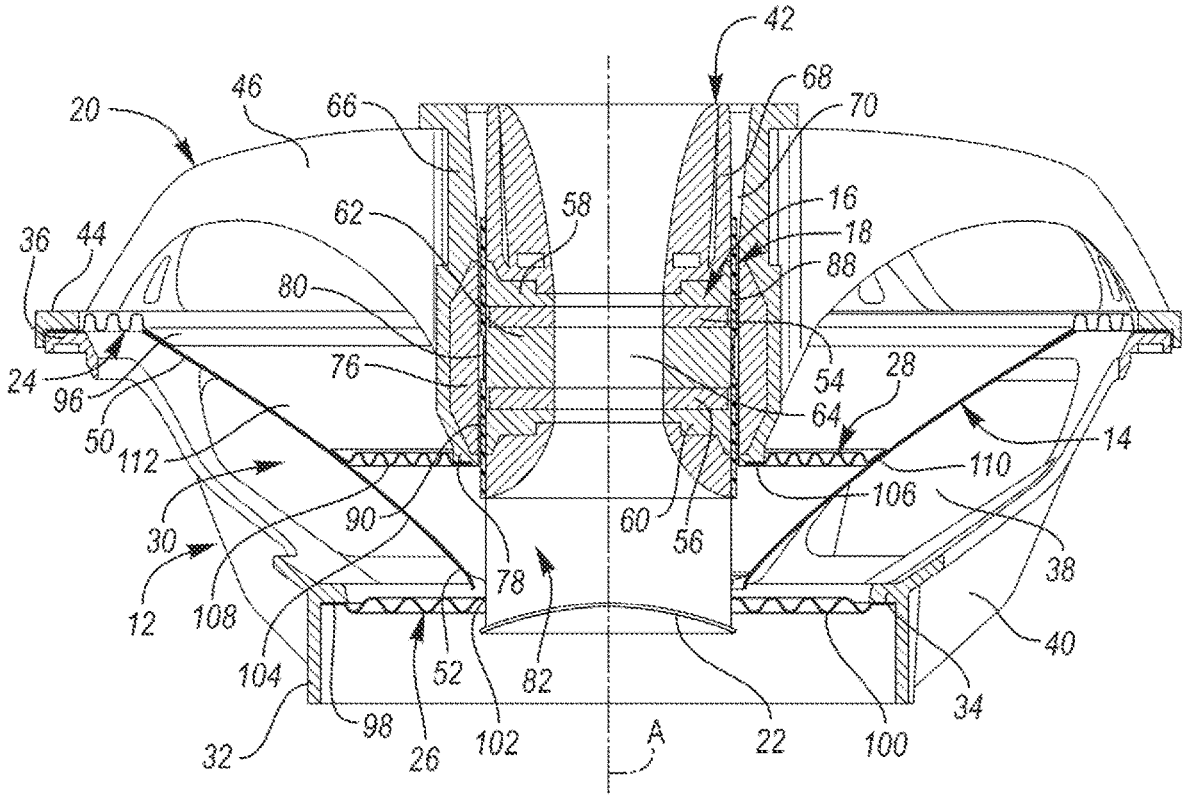
FIG. 1 is a cross-sectional view of an inverted motor transducer having a second, front spider according to an embodiment.

As required, detailed embodiments are disclosed herein; however, it is to be understood that the disclosed embodiments are merely exemplary of the subject matter that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the subject matter.

Embodiments disclosed herein include an inverted motor transducer with a second, front spider positioned forward of the diaphragm, wherein the front spider is attached to both the diaphragm and the front frame of the transducer. The front spider prevents dust and particles from contacting the voice coil and former in the inverted motor transducer. The front spider also provides better dynamic stability of the moving transducer assembly by creating additional dynamic support for the moving assembly, thereby decreasing possible rocking of the voice coil. Still further, the front spider decreases possible overheating of the voice coil, providing increased voice coil cooling by pumping air through the magnetic air gap. These cumulative effects increase the power handling, maximum sound pressure level, and robustness of the inverted motor transducer.

FIGS. 1-4 illustrate an embodiment of an electrodynamic transducer 10 having an inverted motor configuration. The transducer 10 includes a basket or rear frame 12, a cone or diaphragm 14, a magnet assembly 16, a voice coil 18, a front frame 20, a dust cap 22, and a suspension system including a surround 24 and a first spider 26 behind the diaphragm 14. The transducer 10 further includes a second, front spider 28 forward of the diaphragm 14, described further below.

Figure 3:
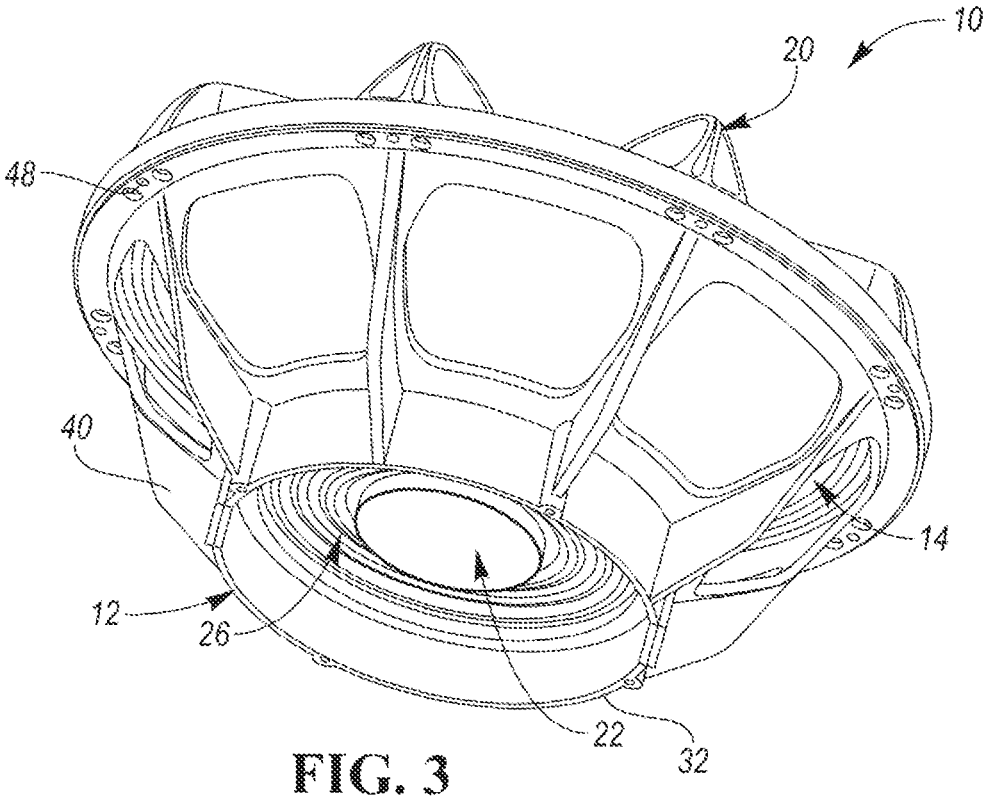
FIG. 3 is a bottom perspective view of the transducer.

As best shown in FIGS. 1 and 3, the rear frame 12 may include a conical construction or other shape defining an open frame interior 30, an annular base 32, a bottom landing 34, and a top landing 36. The rear frame 12 may include one or more cut-outs 38 which define a series of struts 40 extending between the top landing 36 and the annular base 32. The rear frame 12 may generally be constructed from pressed sheet metal, molded from plastic or cast metal such as aluminum or steel, or other suitable material.

Figure 2:
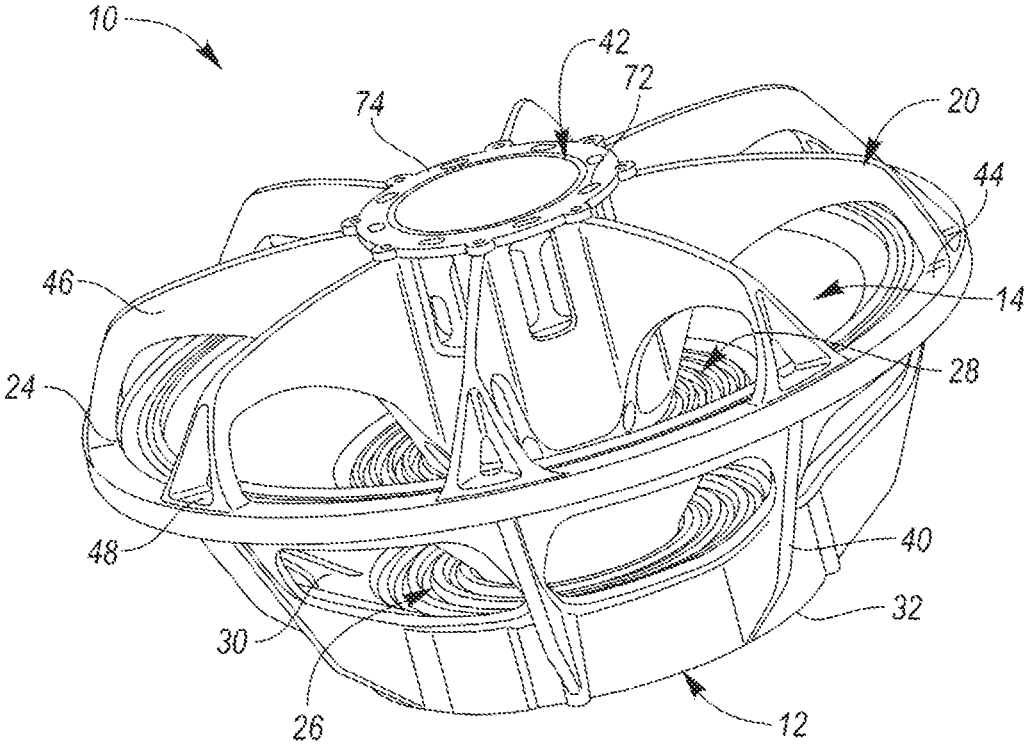
FIG. 2 is a top perspective view of the transducer.

With reference to FIGS. 1 and 2, the front frame 20 encloses the open frame interior 30 and generally includes a "wheel" configuration having a center hub 42 aligned along a central axis A of the transducer 10, an annular outer rim 44, and a plurality of radially arranged spokes 46 coupled between the center hub 42 and the outer rim 44. The front frame 20 may be made from pressed metal, aluminum, cast or forged steel, plastic, ceramic, or any other suitable material. Because the front frame 20 may act as a heat-sinking component, it benefits from the use of material with high thermal conductivity, such as metal. The outer rim 44 may be detachably coupled to the top landing 36 by one or more fasteners (not shown) through fastener holes 48 diametrically arranged around the outer rim 44.

The diaphragm 14, while it may be of any shape, is shown herein as being generally conical, and is operably connected to the rear frame 12. In one or more embodiments, the diaphragm 14 has a first end 50 attached to the surround 24 and a second end 52 attached to the voice coil 18, such as by conventional adhesives. As shown, the diaphragm 14 is positioned within the open frame interior 30 symmetric about the central axis A. The diaphragm 14 may be made from various materials including paper, polymer, metal-based compositions, or other material known in the art for use with diaphragms.

The magnet assembly 16 is positioned forward of the diaphragm 14 and centered around the central axis A, as shown in FIG. 1. In one or more embodiments, the magnet assembly 16 includes a first magnet 54 and a second magnet 56 coupled between a front pole plate 58 and a rear pole plate 60, with a spacer 62 in between the first and second magnets 54, 56. However, in other implementations, the magnet assembly 16 may simply include one, or three or more magnets, and it is understood that other configurations of the magnets and plates may alternatively be utilized. The components of the magnet assembly 16 may be held together by any number of methods, including mechanical fasteners or adhesives. The first and second magnets 54, 56 may be made of neodymium, a material that has a high magnetic flux per mass but could alternatively be constructed of any number of available permanent magnet materials. The front and rear pole plates 58, 60 may be made of ferromagnetic steel or other suitable material with a high magnetic permeability.

As best shown in the cross-sectional view of FIG. 1, the magnets 54, 56, the pole plates 58, 60, and the spacer 62 may be constructed to be annular in shape and to define a contoured or cylindrical port 64 disposed symmetrically about the central axis A. The port 64 provides a path for sound energy which is created by the vibration of the dust cap 22 to combine with the sound energy created by the diaphragm 14, serving to increase the overall radiating area and corresponding acoustic efficiency of the transducer 10. The port 64 provides a further benefit in higher velocity airflow through the relatively small port 64, which can be beneficial for self-cooling of the transducer 10 as high-speed air flows past the components near the port 64.

The center hub 42 may have a hollowed cylindrical configuration with an outer wall 66, an inner wall 68, and an annular interior 70 formed between the inner 66 and outer 68 walls, where the annular interior 70 receives at least a portion of the voice coil 18. In one or more embodiments, the annular interior 70 may communicate with the ambient environment via spaced apertures 72 in a top portion 74 of the center hub 42. The magnet assembly 16 is coupled to and secured in place with respect to the center hub 42 by an adhesive, press fit, or other means. The center hub 42 may be made from pressed metal, aluminum, cast or forged steel, plastic, ceramic, or any other suitable material.

With reference to FIG. 1, the magnet assembly 16 may be positioned within an annular gap sleeve 76 which is coupled to and secured in place at a bottom portion 78 of the center hub 42. Like the pole plates 58, 60, the gap sleeve 76 may be made of ferromagnetic steel. In one or more embodiments, the gap sleeve 76 has a height approximately equal to the combined heights of the magnets 54, 56, pole plates 58, 60, and spacer 62. The magnet assembly 16 may be configured to fit within the gap sleeve 76 such that the inner radius of the gap sleeve 76 is slightly larger than the outer radius of the magnet assembly 16.

The slightly larger radius of the gap sleeve 76 provides an annular magnetic air gap 80 between the magnet assembly 16 and the gap sleeve 76. The voice coil 18 encloses the magnet assembly 16 and is positioned within the magnetic air gap 80 about the central axis A, wherein the voice coil 18 is operably connected to the diaphragm 14. The voice coil 18 may be wound about and securely attached to a cylindrical coil former 82, such as by an adhesive. The coil former 82 may be made of a stiff high temperature resistant material and is free to move axially through the magnetic air gap 80.

The coil former 82 may have an open, top end 84 extending into the magnetic air gap 80 and into the annular interior 70 of the central hub 42, and a bottom end 86 which may be attached to the first spider 26 by an adhesive or other suitable means. The bottom end 86 is closed off by the dust cap 22, which typically has a concave configuration. As described above, the vibration of the dust cap 22 may be used to pump air through the port 64 and through the center hub 42 to provide forced air cooling of the transducer 10.

In the embodiment shown, the voice coil 18 has a dual coil configuration including two distinct coil portions, such that the voice coil 18 in effect constitutes two individual coils. The voice coil 18 is wound around the coil former 82 for a desired number of turns to form a first coil portion 88, then runs down the side of the coil former 82 for an axial distance, and then is wound around the coil former 82 for a desired number of turns to form a second coil portion 90 that is axially spaced from the first coil portion 88. The position of the first coil portion 88 on the coil former 82 may correspond with the front pole plate 58. Similarly, the position of the second coil portion 90 on the coil former 82 may correspond with the rear pole plate 60. In other implementations, the voice coil 18 may include a single coil or more than two coil portions.

The voice coil 18 may be connected to any suitable circuitry (including, for example, an amplifier) for driving the transducer 10. The voice coil 18 oscillates in response to electrical current while being subjected to the constant magnetic field across the magnetic air gap 80 established by the magnetic assembly 16. In operation, the coil former 82 oscillates with the voice coil 18 and the oscillations are translated to the diaphragm 14, thus producing mechanical sound energy correlating to the electrical signals transmitted through the voice coil 18. The acoustic signals propagate or radiate from the vibrating diaphragm 14 to the ambient environment. In this way, the vibrating diaphragm 14 establishes air flow in the interior space of the transducer 10. The inward axial movement of the diaphragm 14 draws ambient air into the transducer 10, and the outward axial movement of the diaphragm 14 generates airflow upward through the port 64 and outwards through the center hub 42 to the ambient environment.

The surround 24 is fastened between the outer rim 44 and the top landing 36 and has an inner flap 96 which overlies and is attached to the first end 50 of the diaphragm 14 by adhesive or other suitable means. The surround 24 may be made of materials such as rubber, compressed foam rubber, corrugated cloth, paper, plastic, treated fabrics, or other suitable material. The surround 24 couples the rear 12 and front 20 frames to the diaphragm 14, and functions to constrain the diaphragm 14 radially while allowing it to vibrate in an axial direction when driven by the voice coil 18. The surround 24 provides a degree of constraint to the maximum excursions of the voice coil 18 and keeps the voice coil 18 centered with the magnetic air gap 80.

Figure 4:
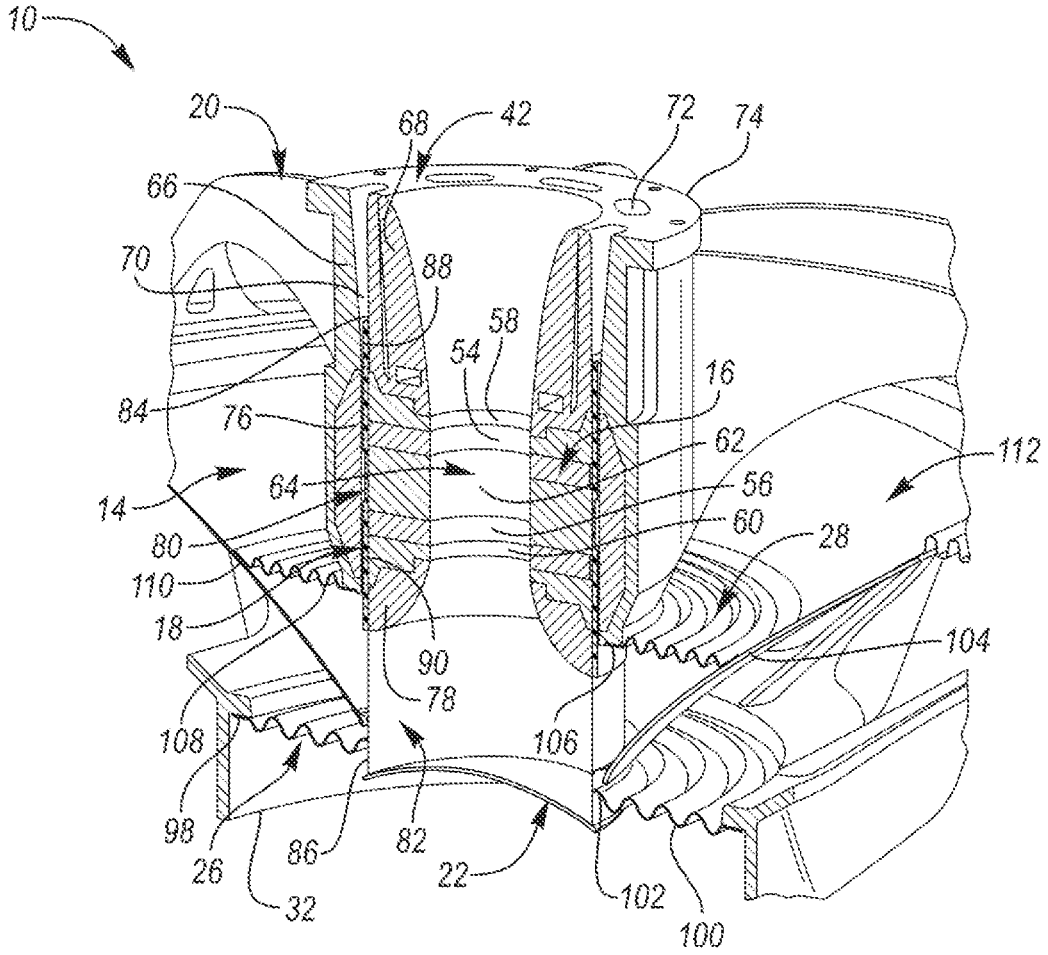
FIG. 4 is a perspective, partially cutaway view of the transducer illustrating the front spider.

As shown in FIGS. 1 and 4, the first spider 26 includes an outer flange 98, an undulation portion 100, and an inner attachment portion 102. The first spider 26 is disposed behind the diaphragm 14 below a rear side 104 thereof, where the outer flange 98 may be attached to the bottom landing 34 of the annular base 32 of the rear frame 12, and the inner attachment portion 102 may be attached to the coil former 82 by adhesive or other suitable means. The first spider 26 may be made of a variety of materials such as phenolic-impregnated cloth, rubber, plastics, textiles, or other material known in the art. Generally, the first spider 26 connects the voice coil 18 to the rear frame 12 and assists in centering the voice coil 18 in the magnetic air gap 80 and about the magnet assembly 16.

As described above, the transducer 10 also includes a second, front spider 28 disposed forward of the diaphragm 14 as illustrated in FIGS. 1, 2 and 4. The second spider 28 includes an inner flange 106, an undulation portion 108, and an outer attachment portion 110. The inner flange 106 may be attached to the center hub 42 or another portion of the front frame 20 as illustrated. The outer attachment portion 110 may be attached to the diaphragm 14 on a front side 112 thereof. It is understood that the second spider 28 is not limited to the particular placement shown herein, but other positions and attachment points forward of the diaphragm 14 are also contemplated. The second spider 28 may be constructed from similar materials as have been described above for the first spider 26. Advantageously, the second spider 28 provides a barrier to prevent detrimental particles and dust from contacting the voice coil 18, coil former 82, and magnetic air gap 80 without requiring a mesh that covers the entire surface of the front frame 20.

Figure 5:
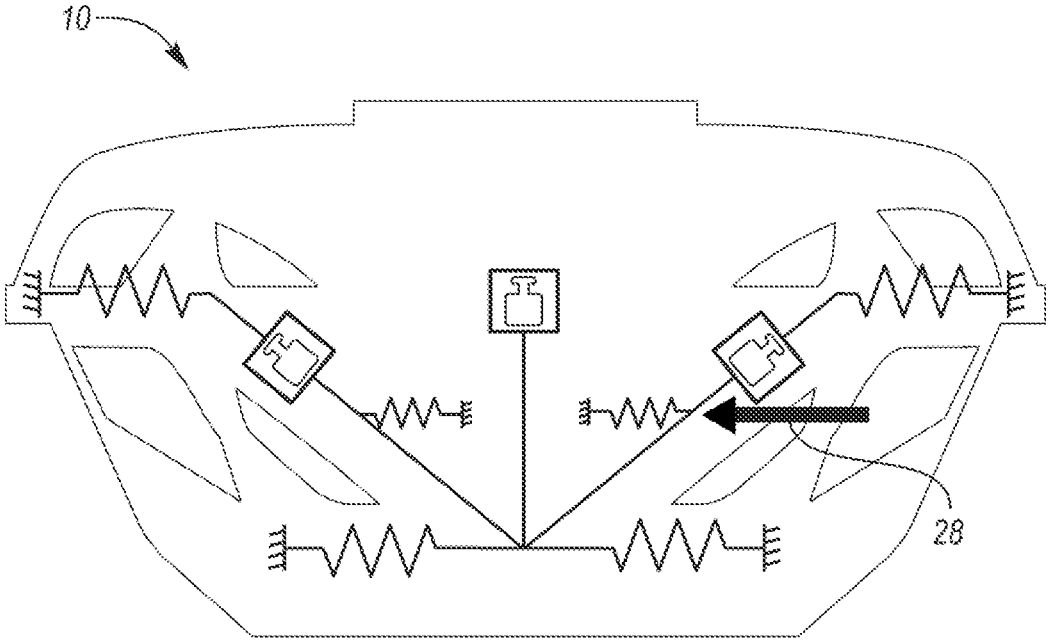
FIG. 5 is a functional depiction illustrating how a second, front spider in an inverted motor transducer provides better dynamic stability and minimizes potential risk of rocking modes, where the arrow indicates the second, front spider.

FIG. 5 is a functional depiction illustrating how the second spider 28 also provides better dynamic stability of the moving assembly in an inverted motor transducer 10 by creating additional dynamic support for the moving assembly. The arrow indicates the second spider 28 positioned forward of the diaphragm 14, where this additional attachment point makes the assembly less prone to rocking modes.

The second spider 28 increases the overall stiffness of the suspension of the moving assembly, where the overall stiffness is a sum of three stiffnesses: stiffness of the surround 24 $K_{msus}(x)$, the stiffness of the first spider 26 $K_{msp1}(x)$, and the stiffness of the second spider 28 $K_{msp2}(x)$. Therefore, the presence of the second spider 28 provides an additional degree of freedom in the stiffness distribution between three suspension components and may contribute to linearization of the overall stiffness as a function of the displacement of the voice coil 18:

$$K_{m\Sigma}(x)=K_{msus}(x)+K_{msp1}(x)+K_{msp2}(x) \quad (1)$$

Another useful feature of the second spider 28 is a possible constant "bias" of the suspension to provide higher linearity of the overall stiffness.

Figure 6:
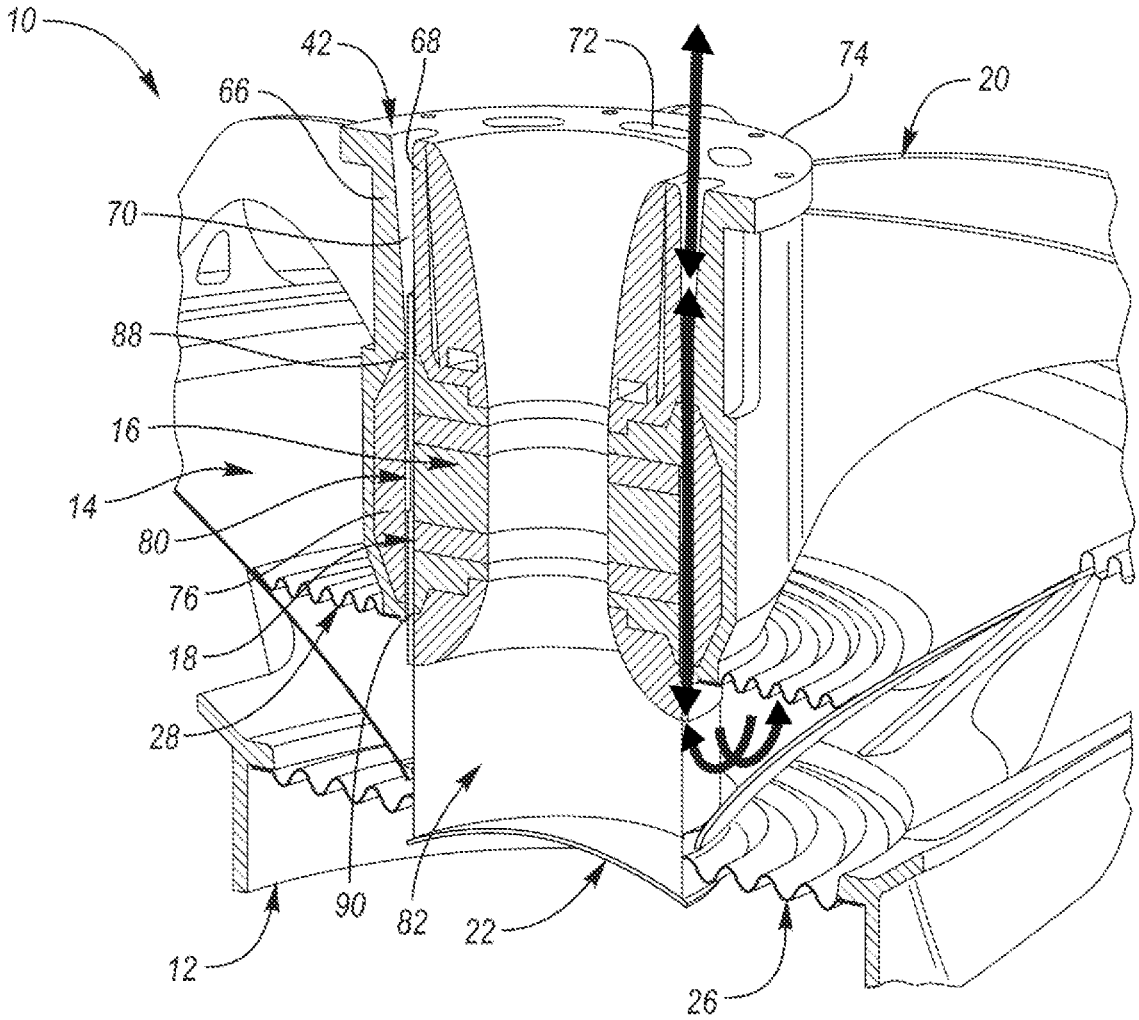
FIG. 6 is a perspective, partially cutaway view illustrating additional cooling of the voice coil in an inverted motor transducer provided by the second, front spider creating a pumping effect by forcing air through the magnetic air gap.

FIG. 6 illustrates the additional, direct cooling of the voice coil 18 provided by the second spider 28 in an inverted motor transducer 10, where the second spider 28 creates a pumping effect by forcing air through the magnetic air gap 80 and the annular interior 70 of the center hub 42. As shown, the air forced by the second spider 28 out of the transducer 10 then returns into the transducer 10 and magnetic air gap 80 via the hub apertures 72 and the annular interior 70. The lower the permeability of the second spider 28, the higher the pumping effect. Due to the nature of the geometry and material of a typical spider, the spider is prone to breakup modes (partial mechanical resonances) in the frequency range of its operation. Higher porosity of the spider provides mechanical damping of these breakup modes. The friction of air running through pores in the material of the second spider 28 causes damping, in which case the pumping effect produced by the second spider 28 becomes less pronounced. Therefore, the degree of porosity of the second spider 28 is a compromise between its pumping capability and the damping of its partial mechanical resonances. The porosity of the second spider 28 can also contribute to releasing hot air to the ambient environment.

The addition of a second, front spider in an inverted motor transducer as disclosed herein provides the positive effects of protecting the magnetic air gap and voice coil components, providing higher dynamic stability of the moving assembly of the transducer, and increasing voice coil cooling. These cumulative effects increase the power handing and maximum sound pressure level of the transducer. A transducer equipped with the second, front spider has lower risk of failure or damage, and is characterized by lower thermal compression that provides better overall performance.

While exemplary embodiments are described above, it is not intended that these embodiments describe all possible forms of the subject matter. Rather, the words used in the specification are words of description rather than limitation, and it is understood that various changes may be made without departing from the spirit and scope of the subject matter disclosed herein. Additionally, the features of various implementing embodiments may be combined to form further embodiments.

What is claimed is:

1. An electrodynamic transducer, comprising:

a rear frame defining an open frame interior;

a front frame enclosing the open frame interior and attached to the rear frame, the front frame including a center hub disposed about a central axis of the transducer, the center hub including an outer wall, an inner wall, and an annular interior formed between the inner and outer walls, the center hub including spaced apertures in a top portion thereof which allow the annular interior to communicate with the ambient environment;

a movable diaphragm positioned within the open frame interior and operably connected to the rear frame;

a magnet assembly disposed forward of the diaphragm and coupled to the center hub, the magnet assembly defining a magnetic air gap annularly disposed about the central axis and in communication with the annular interior of the center hub;

a voice coil disposed in the magnetic air gap surrounding the magnet assembly, the voice coil attached to a cylindrical coil former which is connected to the diaphragm;

a first spider coupled between the voice coil and the rear frame behind the diaphragm; and a second spider having an undulating configuration, the second spider coupled between the diaphragm and the center hub and disposed forward of the diaphragm, the second spider having an inner flange connected to the center hub adjacent the coil former such that an enclosed space is bounded by the second spider, the diaphragm, and the coil former, wherein when an electrical signal is passed through the voice coil to cause the voice coil and diaphragm to oscillate, the second spider pumps air in and out of the transducer from the enclosed space through the magnetic air gap and the annular interior of the center hub.

2. The transducer of claim 1, wherein the second spider includes an outer attachment portion attached to the diaphragm on a front side thereof.

3. The transducer of claim 1, wherein the magnet assembly includes a front pole plate spaced from a rear pole plate and at least one magnet disposed therebetween.

4. The transducer of claim 3, wherein the front pole plate, the rear pole plate, and the at least one magnet are annular in shape, defining a port therethrough disposed about the central axis of the transducer.

5. The transducer of claim 1, further comprising a gap sleeve coupled to the center hub and surrounding the magnet assembly, wherein the magnetic air gap is defined between the magnet assembly and the gap sleeve.

6. The transducer of claim 1, further comprising a dust cap covering a bottom end of the coil former.

7. The transducer of claim 1, wherein the voice coil has a dual coil configuration including a first coil portion spaced from a second coil portion.

8. The transducer of claim 1, wherein the front frame includes an annular outer rim and a plurality of radially arranged spokes coupled between the center hub and the outer rim.

* * * * *